US006367227B1

(12) United States Patent
Veyna

(10) Patent No.: US 6,367,227 B1
(45) Date of Patent: Apr. 9, 2002

(54) TILE SETTING RACK FOR FIREPLACE

(76) Inventor: Toby James Veyna, 1309 Foxworthy, San Jose, CA (US) 95118

( * ) Notice: Subject to any disclaimer, the term of this patent is extended or adjusted under 35 U.S.C. 154(b) by 0 days.

(21) Appl. No.: 09/533,829

(22) Filed: Mar. 23, 2000

(51) Int. Cl.[7] ..... E04G 21/00

(52) U.S. Cl. ..... 52/747.1; 52/747.11; 52/749.11; 52/389; 33/410

(58) Field of Search ..... 52/127.2, 387, 52/746.1, 747.11, 749.11, 749.15, DIG. 1, 747.1, 389; 33/404, 410, 518, 526, 527

(56) References Cited

U.S. PATENT DOCUMENTS

| | | | | | |
|---|---|---|---|---|---|
| 1,941,404 | A | * | 12/1933 | Lansing | 33/410 |
| 2,576,983 | A | * | 12/1951 | Walker | 40/618 |
| 3,744,141 | A | * | 7/1973 | Strickland | 33/180 |
| 3,968,191 | A | | 7/1976 | Stegmeier | 264/34 |
| 4,516,373 | A | | 5/1985 | Osawa | 52/387 |
| 4,583,343 | A | | 4/1986 | Camp | 52/749 |
| 5,010,654 | A | * | 4/1991 | Funes, Jr. | 33/526 |
| 5,263,260 | A | * | 11/1993 | Smith | 33/526 |
| 5,692,311 | A | * | 12/1997 | Paquin | 33/647 |
| 6,044,570 | A | * | 4/2000 | Nochowitz | 33/526 |

* cited by examiner

*Primary Examiner*—Beth A. Stephan
*Assistant Examiner*—Masko Slack
(74) *Attorney, Agent, or Firm*—Robert S. Smith

(57) ABSTRACT

A bridge for aiding in setting tile on a surface above a fireplace including a pair of horizontal elongated guide bars and a pair of vertical elongated support bars, each guide bar and support bar having an elongated slot, the guide pair bolted together through slots providing a single guide bar. Each end of the single guide bar is bolted to near an end of a support bar by a fastener through the slots so that the bridge is formed. In use, the bridge is positioned at the entrance to the fireplace with a lower end of each support bar supported on the floor of the fireplace. The single guide bar is positioned along the top edge of the entrance and a first course of files is set against a front surface of a wall above the fireplace with a lower edge of each tile arranged parallel to and along the horizontal edge. A marker clip is snapped onto the guide bar and moved along to position each successively laid tile.

7 Claims, 2 Drawing Sheets

FIG. 4

1. ASSEMBLE BRIDGE IN THE FIREPLACE

2. LAY FIRST TILE AGAINST BRIDGE AND MARKER

3. SELECT CLIP ACCORDING TO TILE SPACING

4. ATTACH CLIP TO GUDE BAR

5. SET SECOND TILE AGAINST GUIDE BAR AND CLIP

6. REPOSITION THE CLIP ON THE GUIDE BAR.

7. REPEAT STEPS 5 AND 6 UNTIL THE COURSE IS COMPLETE

TILE SETTING RACK FOR FIREPLACE

FIELD OF THE INVENTION

This invention relates to racks for laying tiles and particularly to a rack for laying tile on the vertical wall above a fireplace.

BACKGROUND AND INFORMATION DISCLOSURE

Tiled surfaces on the interior walls of buildings, particularly the bathrooms and kitchens of private residences is a very desirable feature. A number of supports have appeared on the market that have been intended to facilitate laying tiles against the wall.

For example, U.S. Pat. No. 3,850,404 to Stegmeier discloses a rack for laying a single course of tile along the water line of a swimming pool.

U.S. Pat. No. 4,583,343 to Camp discloses a tile setting kit for uniform placement of tiles on either a vertical or horizontal surface including a starter rack with uniformly displaced spacers that is set on the floor for setting the first course of tiles, an elongated guide frame having replaceable spacer rails with a plurality of uniformly arranged spacer teeth and a support structure with a brace arm and suction attachment that engages the adjacent lower Course of set tiles.

U.S. Pat. No. 4,516,373 to Osawa discloses an apparatus for setting tiles on a surface of plaster comprising a rack of vertical bars and horizontal bars welded or screwed together and joined permanently to the wall.

For many years, bricks and stone have been the material of choice for building fireplaces in these residences. To some extent, the selection of a finished surface of brick (painted or unpainted) or bare stone rather than a finished tile surface over brick or stone has been dictated because of the extra expense and difficulties required to lay the tile on the wall extending up over the fireplace. A major difficulty is the job of laying the first course of tiles evenly along the top edge of the fireplace opening. None of the cited art is adapted for laying the first course of tiles along the top edge of the fireplace,

SUMMARY OF THE INVENTION

It is an object of this invention to provide a support and method of using the support to set a first course of tile along the top edge of a fire place opening.

It is another object that the support be adjustable to accommodate setting tiles over fireplaces where height of the top edge of the fireplace above the ground level is any one of a range of heights and any one of a range of widths.

This invention is directed toward a bridge for aiding in setting tile on a surface above a fireplace having an entrance, with a width and height, a floor and a top edge. The bridge includes a guide pair of elongated guide bars and a support pair of elongated support bars, each guide bar and support bar having an elongated slot. The guide pair of guide bars is bolted together by fasteners through the slots providing a single guide bar having two ends. Each end of the single guide bar is bolted to near an end of one of the support bars by a fastener through the slots, thereby forming the bridge and permitting that the bridge be positionable at the entrance to the fireplace. A lower end of each support bar is supported on the floor of the fireplace with the single guide bar positionable along the top edge of the entrance. A plurality of tiles is set against a front surface of a wail above the fireplace with a lower edge of each tile arranged parallel to and along the horizontal edge with each tile resting against a top edge of the single guide bar;

BRIEF DESCRIPTION OF THE DRAWINGS

These and other features, aspects and advantages of the present invention will become better understood with regard to the following description, appended claims, and accompanying drawings, where:

FIG. 4 is a flow chart of the method of setting tile according to the invention.

DESCRIPTION OF THE BEST MODE

Figure 1:
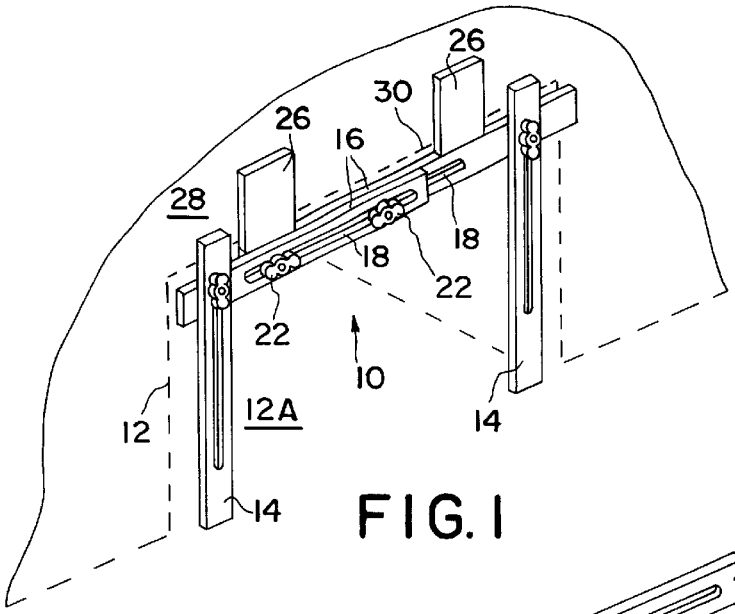
FIG. 1 shows an assembly perspective view of the invention.
Figure 2:
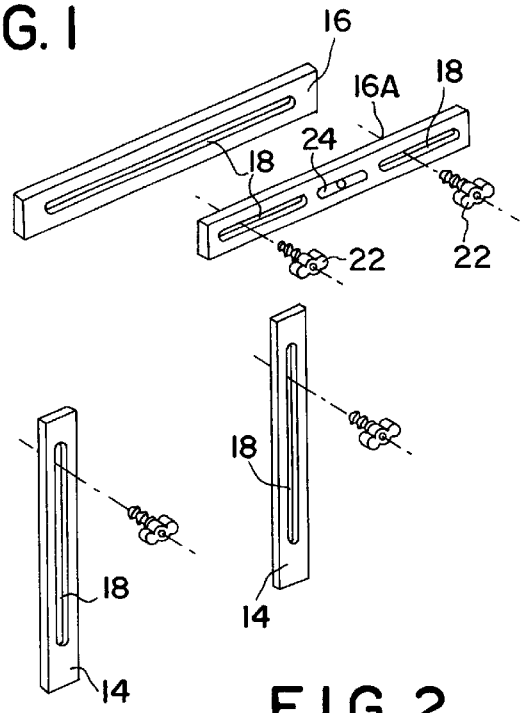
FIG. 2 shows an exploded view of the invention.

Turning now to a discussion of the drawings, FIG. 1 shows a perspective view of the bridge 10 of this invention. FIG. 2 shows an exploded view of the bridge for a fire place 12 of this invention including a support pair 14 and a guide pair 16 of elongated flat bars. Each bar has a thickness of about ⅛ inch. Each bar has an elongated slot 18 The end of each guide bar 16 overlaps the end of the other guide bars 16 and wing bolts 22 through the slots 18 fasten the two guide bars 16 together.

FIG. 2 shows a slot 18A in guide bar 16 A interrupted by a leveling bubble 24.

FIG. 1 shows the bridge positioned in a fireplace 12 (in phantom) and serving as a support for the first two tiles 26 of the first course of tiles laid on the vertical surface 28 at the lower edge 30 above the fireplace 12A. The support 14 pair of bars are vertical with lower ends of the bars supported on the ground. The second pair of bars are aligned with one another and horizontal. The procedure of laying the first two tiles 26 of the first course is preferable rather than laying the entire course of tiles side by side one after the other because it has been found to give better assurance that the tiles will be set in line.

Figure 3:
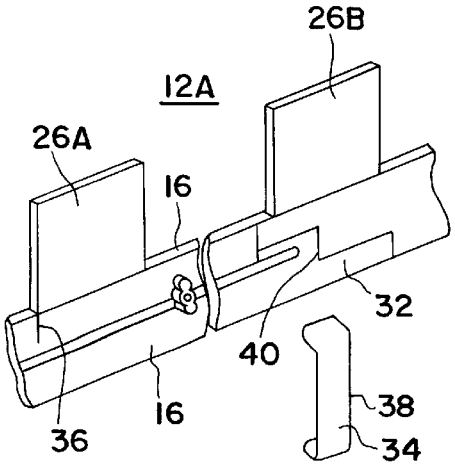
FIG. 3 shows details of the scale, level and positioning of the first two tiles.

Each job of setting tile has its own set of specifications of tile width and spacing between tiles. Different tile companies sell tiles having different widths. FIG. 3 shows an embodiment of this invention in which the broad surfaces of the guide bars have a scale 32 with indicia 32 that the tile layer uses to pace the first course of tiles 26 along the edge 30 of the fireplace 12. The scale 32 is shown on only one surface of the outmost guide bar 16 however, it will be understood that all of the surfaces of the guide bars 16 may have a scale so that many of the various sizes, each with an array of possible spaces may be represented. A clip 34 is clipped onto the guide bar 16 as a further aid in setting the first course of tiles 26 as further described below.

FIG. 4. is a flow chart of the steps of the invention for using the bridge including the scales to lay the first course of tiles.

In the first step, the bridge is assembled as shown in FIG. 4 and positioned against the fireplace with the top edge of the guide bar coincident with the bottom edge of the of the wall above the fireplace.

In the second step, the first tile 26A is laid with a lower corner aligned with a "zero" mark 36 on the guide bar 16. The tile 26A is secured against the wall 12A by adhesive as is well known in the field.

In a third step, a clip is selected from a store of clips having various sizes ,herein the selected clip has a width equal to the required spacing between tiles.

In the fourth step, the selected clip 34 is is secured astraddle the guide bar with one edge 38 aligned with one of the vertical alignment lines 40 selected in accordance with the width of the tile and the required spacing between tiles.

In the fifth step, a second tile is set with the bottom edge on the top edge of the guide bar and the lower corner of the tile positioned against the clip.

In the sixth step, the clip is withdrawn from the bar and clipped onto the guide bar on the other side of tile in preparation for setting the next tile.

In step seven, steps five and six are repeated until the complete first course of tile is set.

In another embodiment, as shown in FIG. 2, two in-line slots are formed in place of one long slot in the guide bar and a level bubble 24 is set in the guide bar 16A to guide the laying of the first course of tiles 26.

The bridge of this invention greatly facilitates laying the first course of tile in a straight line along the top edge of a fireplace. The bridge is easily adjusted to accommodate various sizes of the fireplace openings. The use of the clip and the scale to the horizontal bars conveniently ensures that the tiles will be evenly spaced from one another d the time required to set the first course of tiles is substantially reduced.

Modifications and variations of the invention may be contemplated after reading the specification and studying the drawings which are within the scope of the invention. I therefore wish to define the scope of my invention by the appended claims.

I claim:

1. A method for setting tile on a surface above fireplace having an entrance, with a width and height, a floor and a top edge, said method including the steps:

(A) forming a bridge which comprises:

(i) a guide pair of elongated guide bar and a support pair of elongated support bars, each guide bar and support ba having an elongated slot;

(ii) said guide pair bolted together by a plurality of fasteners through said slots providing a single guide bar having two ends;

(iii) each end of said single guide bar bolted to near an end of one of said support bars, respectively, by a fastener through said slots whereby said bridge is formed permitting that said bridge be positionable at the entrance to the fireplace with a lower end of each said support bar supported on the floor of the fireplace and with said single guide bar positonable along the top edge of the entrance and further permitting that a plurality of tiles be set against a front surface of a wall above said fireplace with a lower edge of each tile arranged parallel to and along said horizontal edge and each tile resting against a top edge of said single guide bar;

said guide bars having at least one broadest surface with indicia operably arranged to enable required placement of said plurality of tiles against said wall;

(v) a marker clip that detachably clips onto said single guide bar;

(B) positioning said bridge at the entrance to the fireplace with a lower end of each said support bar supported on the floor of the fireplace and with said single guide bar positioned along the top edge of the entrance:

(C) setting a plurality of tiles against a front surface of a wall above said fireplace and attaching said marker clip to said single guide bar as each tile is set at a location required for setting a first course of tiles with a lower edge of each tile arranged parallel to and along said horizontal edge and each tile resting against a top edge of said single guide bar and aligned with said indicia.

2. The method of claim 1 wherein one of said guide bars has a level and said step (B) further includes the step of adjusting attachment of said support bars to said single guide bar to level said single guide bar.

3. A method for setting tile on a surface above a fireplace having an entrance, with a width and height, a floor and a top edge, said method including the steps:

(A) forming a bridge which comprises:

(i) a guide pair of elongated guide bars and a support pair of elongated support bars, each guide bar and support bar having an elongated slot;

(ii) said guide pair bolted together by a plurality of fasteners through said slots providing a single guide bar having two ends;

(iii) a level on one of said guide bars (iii) each end of said single guide bar bolted to near an end of one of said support bars, respectively, by a fastener through said slots thereby said bridge is formed permitting that said bridge be positionable at the entrance to the fireplace with a lower end of each said support bar supported on the floor of the fireplace and with said single guide bar positionable along the top edge of the entrance and further permitting that a plurality of tiles be set against a front surface of a wall above said fireplace with a lower edge, of each tile arranged parallel to and along said horizontal edge and each, tile resting against a top edge of said single guide bar;

(iv) said guide bars having at least one broadest surface with indicia operably arranged to enable required placement of said plurality of tiles against said wall (v) a marker clip that detachably clips onto said single guide bar (B) positioning said bridge at the entrance to the fireplace with a lower end of each said support bar supported on the floor of the fireplace and with said single guide bar leveled with said level and positioned along the top edge of the entrance:

(C) setting a plurality of tiles against a front surface of a wall above said fire lace with a lower edge of each tile arranged parallel to and along said horizontal edge and each tile resting against a top edge of said single guide bar and aligned with said indicia by successive attachment of said marker clip to said single guide bar as each tile is set at a location required for setting of first course of tiles.

4. The bridge of claim 3 wherein one of said guide bars has a level permitting adjustment of attachment of said support bars to said single guide bar to level said guide bar.

5. The bridge of claim 4 wherein said bridge further comprises a marker clip that detachably clips onto said single guide bar and permitting attachment of said marker clip to said single guide bar as each tile is set at a location required for setting of first course of tiles.

6. The bridge of claim 3 wherein said guide bars has at least one broadest surface with indicia operably arranged to enable required placement of said plurality of tiles against said wall permitting alignment of said tiles with said indicia.

7. A bridge for aiding in setting tile on a surface of a wall above a fireplace having an entrance, with a width and height, a floor and a top edge, said bridge comprising:

a guide pair of elongated guide bars and a support pair of elongated support bars, each guide bar and support bar having an elongated slot;

said guide pair bolted together by a plurality of fasteners through said slots providing a single guide bar having two ends;

indicia operably operably arranged on a surface of one of said guide bars to enable required placement of said plurality of tiles against the surface of the wall permitting alignment of said tiles with said indicia;

a level operably attached to a broadest surface of one of said guide bars arranged to permit adjustment of attachment of said support bars to said single guide bar to level said single guide bar;

each end of said single guide bar bolted to near an end of one of said support bars by a fastener through said slots whereby said bridge is formed permitting that said bridge be positionable at the entrance to the fireplace with a lower end of each said support bar supported on the floor of the fireplace and with said single guide bar positionable along the top edge of the entrance and further permitting that a plurality of tiles be set against a front surface of a wall above said fireplace with a lower edge of each tile arranged parallel to and along said horizontal edge and each tile resting against a top edge of said single guide bar;

marker clip that detachably clips onto said single guide bar and permitting attachment of said marker clip to said single guide bar as each tile is set at a location required for setting of first course of tiles.

* * * * *